United States Patent [19]

Siddoway

[11] Patent Number: 4,750,913

[45] Date of Patent: Jun. 14, 1988

[54] COOLING OF DRIED COAL

[75] Inventor: Mark A. Siddoway, Houston, Tex.

[73] Assignee: Shell Mining Company, Houston, Tex.

[21] Appl. No.: 943,456

[22] Filed: Dec. 19, 1986

[51] Int. Cl.[4] ..... C10L 9/08; F26B 7/00

[52] U.S. Cl. ..... 44/626; 34/13

[58] Field of Search ..... 44/1 R, 1 G; 34/13, 34/20

[56] References Cited

U.S. PATENT DOCUMENTS 4,043,763 8/1977 Norman et al. ..... 44/1 R 4,396,394 8/1983 Li et al. ..... 44/1 G

*Primary Examiner*—Carl F. Dees

[57] ABSTRACT

Wet coal is processed in a dryer, producing dry, hot coal. More wet coal is blended with the dry, hot coal and the mixture is processed in a cooler, resulting in a cool, blended dry coal.

12 Claims, 2 Drawing Sheets

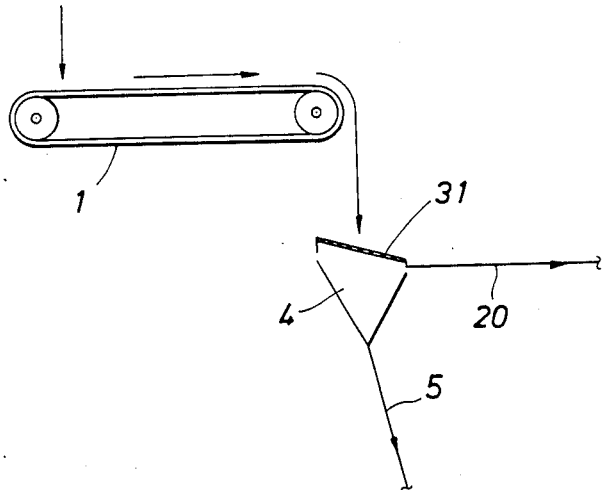
FIG. 2
FIG. 3
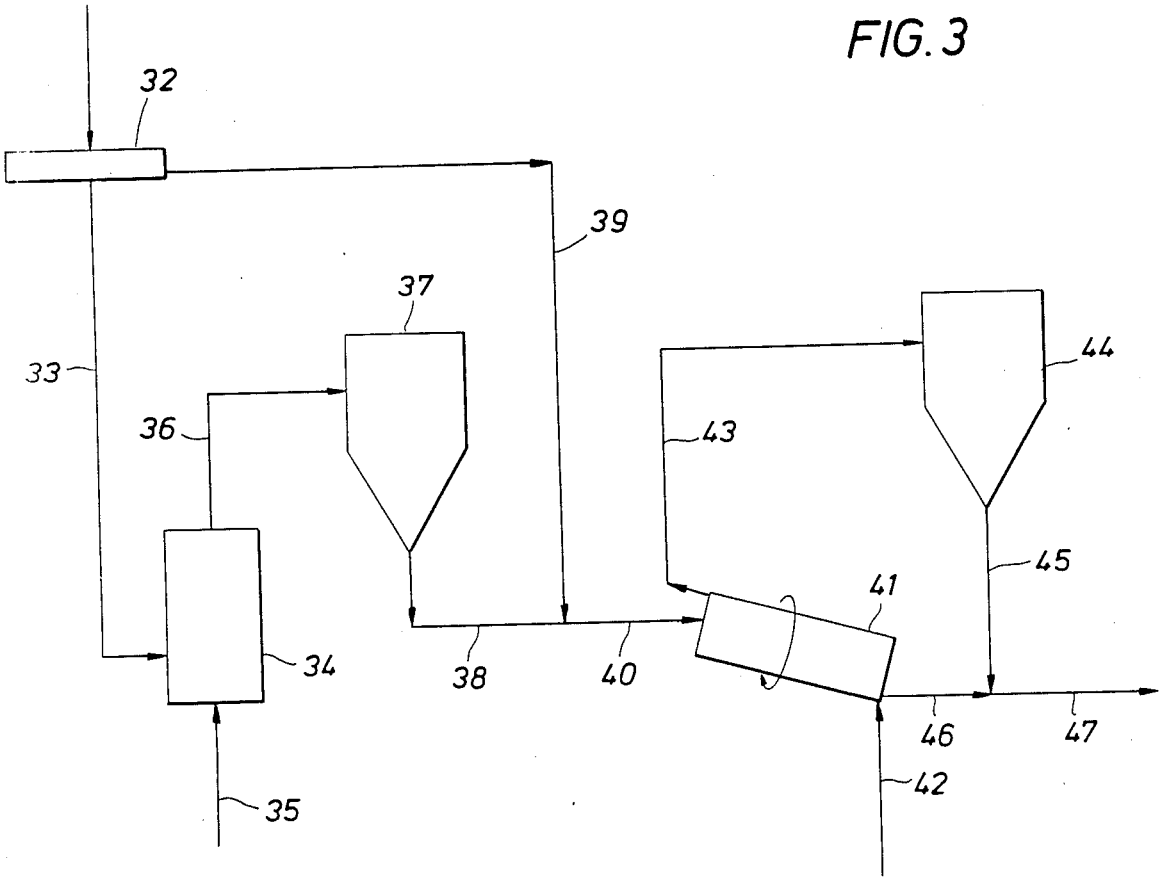

COOLING OF DRIED COAL

BACKGROUND OF THE INVENTION

To make low rank coals more competitive, several drying processes have been proposed to remove water from either lignite or subbituminous coal so that the specific heating value of the product is increased (U.S. Pat. Nos. 3,723,079; 3,985,516; 4,043,763; 4,192,650; 4,213,752; 4,396,394; and 4,401,436). These processes remove both surface moisture and moisture in the coal's pore structure. An inherent disadvantage of all these drying processes is that the coal must be heated in order to remove the water from the coal with a reasonable residence time in the dryer. Hence, after drying, the coal must be cooled to prevent spontaneous ignition. Several methods of accomplishing this have been proposed. Seitzer (U.S. Pat. No. 4,043,763) proposed simply blending wet and hot dried coal together after a drying process with no further processing. Other methods have included rehydration (U.S. Pat. Nos. 4,192,650 and 4,401,436). In particular, Bonnecaze (U.S. Pat. No. 4,401,436) added water to the dried coal before the coal was passed into a fluidized bed cooler where ambient air is drawn through the bed to cool the coal. Increased evaporation in the cooler then allows a cooler final product.

In general, the coal must be cooled to less than 100° F. so that it will not spontaneously ignite after a drying process. This can be accomplished in a cooling fluid bed where ambient air is fed through the bed of coal. Cooling occurs by convective heat transfer and by evaporative cooling. Evaporation is the major contributor to cooling, and it is best to have the coal as wet as possible before the cooler. However, this contradicts the process in that coal is generally quite dry after the dryer, and the further removal of water is difficult. While this can be overcome by adding water to the coal prior to cooling, this offsets some of the effect of drying. That is, water is removed in one step, water is added in the second step, and the coal is cooled by evaporation in a third step.

It is also feasible to dry the coal by partial combustion. However, this may be undesirable from a product standpoint, among several reasons. This type of drying raises the coal to a very high temperature making it difficult to cool. It also partially consumes the coal during drying and hence lowers the dry basis heating value of the coal. For example, Blake (U.S. Pat. No. 4,324,544) teaches a process for drying coal in a fluidized bed by partial combustion, discharging from the bed and mixing with a stream of wet particulate coal, the combined stream then being cooled in a fluidized bed cooler where the fluidizing gas is the dryer's exhaust gas. Utilizing the dryer exhaust gas does not permit enough evaporative cooling due to the high humidity of the flue gas. In addition, gas condensation problems may arise when the cooler exhaust gas is passed through dust collection equipment.

Also, Seitzer (U.S. Pat. No. 4,213,752) teaches a process for removing moisture from low rank coal by feeding wet low rank coal into a moving bed of hot coal undergoing partial combustion, the moving bed being a fluidized bed.

Among other relevant art, Riess et al (U.S. Pat. No. 4,501,555) discloses a process for producing a dried particulate coal fuel from a particulate low rank coal using a fluidized bed apparatus. Nathan (U.S. Pat. No. 2,933,822) introduces finely divided solids wet with a liquid material into a dense phase fluidized bed containing similar solids having a lower liquid content. Ottoson (U.S. Pat. No. 4,495,710) provides a process for stabilizing particulate low rank coal in a fluidized bed.

SUMMARY OF THE INVENTION

The primary purpose of the present invention is to provide a process for drying coal without subjecting the coal to combustion. Accordingly, the process of the present invention is practiced by separating the coal into two streams; noncombustibly heating and drying one of the streams; blending the heated stream with the other stream; and cooling the combined stream of particles.

Preferably, the process is practiced by separating the coal into a stream of coarse particles and a stream of small particles; non-combustibly heating and drying the small particles; blending the heated stream of small particles with the stream of coarse particles; and cooling the combined stream of particles by drawing a dry, ambient temperature gas through the combined steam. Even more preferably, the process includes drying the small particles with a stream of hot air and recycling at least part of the stream of hot air. Further, the process includes separating fine particles from the combined stream of particles and utilizing the fine particles as fuel to provide heat for heating and drying the stream of small particles.

Other purposes, distinctions over the art, advantages and features of the invention will be apparent to one skilled in the art upon review of the following.

BRIEF DESCRIPTION OF THE DRAWINGS

FIG. 2 is a variation of the process of FIG. 1 wherein the wet coal stream is split into coarse particles and small particles utilizing a screen.

FIG. 3 depicts a specific process for cooling coal which uses a rotary drum cooler.

DESCRIPTION OF THE PREFERRED EMBODIMENT

Figure 1:
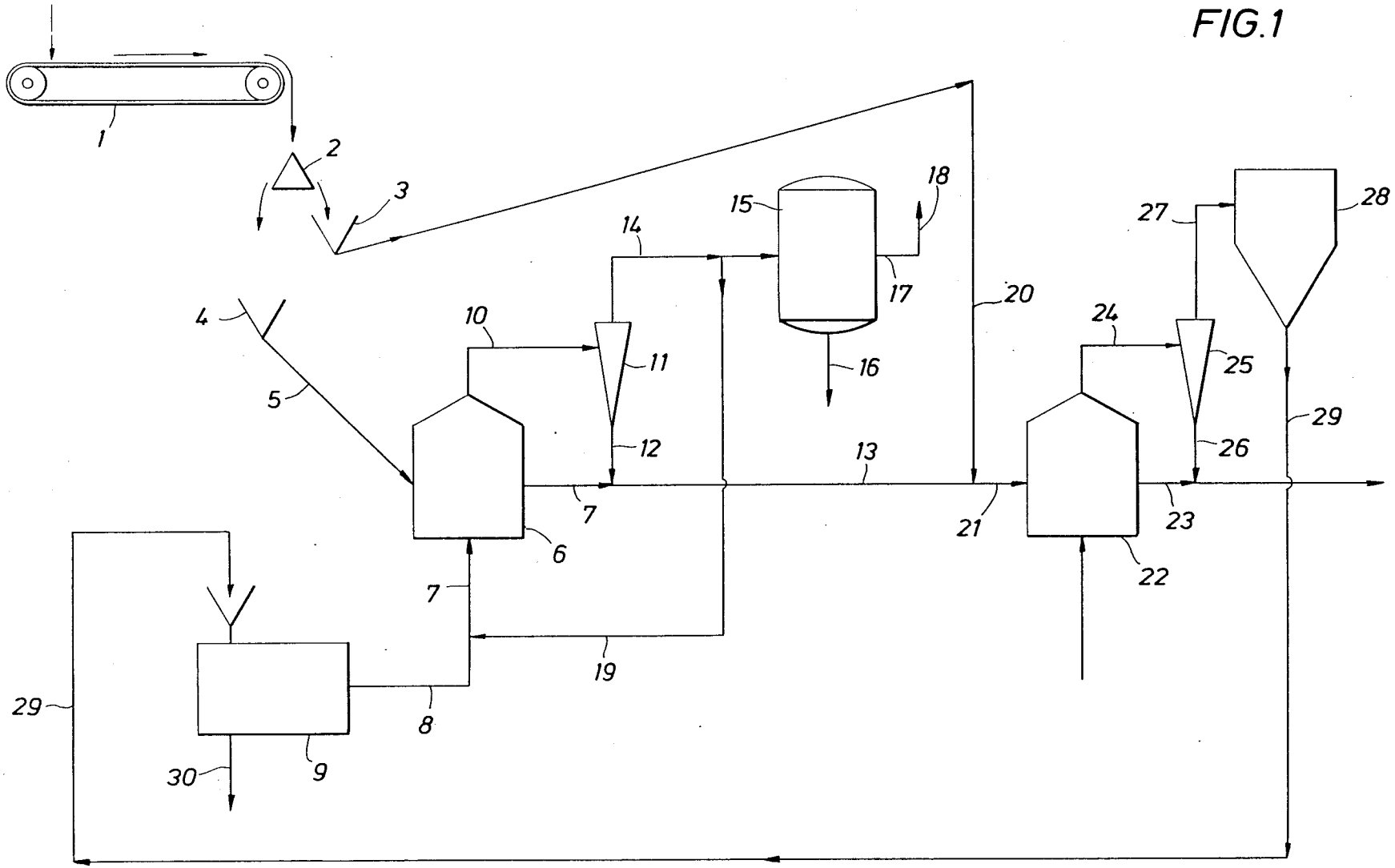
FIG. 1 is a flow diagram illustrating a specific process for cooling coal which uses a fluid bed cooler. A splitter is utilized to split the wet coal streams into two different streams.

There is shown in FIG. 1 the necessary process and apparatus to turn a continuous stream of wet coal into a stream of dry coal which is ready for transportation, use, storage or the like.

Wet coal, for example, ¾"xO, is supplied to the process by means of a conveyor 1. As the coal falls onto a splitter 2, part of the stream is passed to a wet coal hopper 3 and the remainder of the stream is passed to a dryer feed hopper 4. The latter stream is passed via line 5 to a fluidized bed dryer 6. A bed of particulate coal in the dryer is maintained fluidized in a manner known in the art by a stream of hot gas 7 entering at the bottom of the dryer.

Preferably, half of the coal is thermally dried in the fluid bed where the coal is heated to a product temperature of 100°–200° F. The other half of the coal bypasses the dryer and is blended with the half that was dried, as described hereinafter. The ratio of wet coal to dry coal may be varied, depending upon process needs and equipment sizing. Coal continuously enters the fluid bed dryer 6 via line 5 and is discharged on the opposite side of the dryer via line 7 as hot, dry coal. At least part of hot gas stream 7 is provided by stream 8 from a furnace 9 and drier exhaust gas 10 is removed from fluid bed dryer 6 and then passed into a cyclone 11 as is known in the art. Cyclone fines are removed from cyclone 11 via line 12 and blended with the heated coal stream 7 to produce a blended stream 13. Exhaust gas 14 from the cyclone is split, preferably about two-thirds/one-third, and part may be passed through a wet scrubber 15 from which a fine slurry 16 is passed to a sedimentation tank, pond, or the like (not shown), and exhausted via line 18 to the atmosphere, while the remainder is recycled via line 19 to be merged with stream 8 and to form hot gas stream 7. Stream 19, which preferably is about two-thirds of stream 7, functions to keep the dryer oxygen level down and thereby prevent combustion of the coal within the fluid bed dryer 6. As above mentioned, preferably half of the coal bypasses the dryer via wet coal bypass line 20 and is blended with the half that was dried. The blend is then passed via line 21 to a fluid bed cooling vessel 22 and a dry, cool, blended product is produced via line 23. Since the cooler size must be increased when more wet coal is used, preferably the minimum amount of wet coal is added to accomplish the desired degree of cooling. An overhead stream 24 containing coal dust is removed from fluid bed cooler 22 and passed to a cyclone 25. Coal fines are removed via line 26 and recombined with stream 23 to produce a dry, cool blend of coal. Stream 27 taken from cyclone 25 is then passed to a baghouse 28 of a type known to the art and the remaining coal dust is collected and then recycled via line 29 to furnace 9 wherein it is burned. Bottom ash is removed from the furnace via line 30. With regard to the dust collection equipment for the cooler exhaust, care is taken so that condensation does not occur, particularly in the baghouse 28 and the auxiliary fans and/or compressors. This is accomplished by slightly heating the baghouse or the inlet gas to the baghouse (e.g. via heat exchange with the dryer exhaust). Another method is to use adequate ambient airflow rates or shorter conduct times to lower the humidity of the cooler exhaust gas and/or remove mist from the gas. Still another method is to use a scrubber which can accept condensing gas streams such as a venturi scrubber.

Another method for accomplishing the coal drying is shown in FIG. 2. In this embodiment, the dryer preferably handles material with a relatively small size, for example, a top size of ¾". The coal is screened with a screen 31 into material suitable for the dryer and the coarser material bypasses the dryer via line 20, as shown in FIG. 2. The finer material, typically ½" to 1" top size comprises 40 to 90 percent of the coal. The finer material then passes via line 5 to the dryer and the coarser material is blended with the hot, dry, fine material before the cooler 22. Since only ambient air is necessary in the cooler, the coarser material, for example 2" top size wet coal, can be handled due to the lower temperature (e.g. 80°–100° F.) involved. That is, dead spots are not as critical in the cooler since the air temperature is cooler. Preferably, the screen is a ¾"-mesh screen and wet ¾"xO coal is passed through the fluid bed dryer 6. A dry, cool product which has suitable type size for other uses is produced. While it is desirable to cool the coal to less than about 100° F., it is preferable to cool the coal to as close to the ambient temperature as possible. Once such use is for producing a 2-inch top size material suitable for rail shipment with a fluid bed dryer capable of drying only −¾" material. Variations of this are of course feasible. The wet material which bypasses the dryer may be split into two streams. One of these streams is blended with the dry coal before the cooler and the remainder can be added after the cooler. This splitting process is accomplished by screening the bypassed coal to create a stream with a particle size distribution that is suitable for the cooler or by a simple dividing scheme where the particle size distribution is not altered. Also, the fine material may be split before it enters the dryer. Part is diverted around the dryer and blended with the hot, dry coal before it enters the cooler. The coarse material is then added to the dry, cool blend after the cooler. In addition, variations using a combination of the above are feasible. Necessary size modifications are accomplished via agglomeration or size reduction.

The cooling process of this invention can be used in combination with other drying equipment including an evaporative fluid dryer, a flash dryer, or a rotary dryer, in a high pressure and high temperature drying scheme. A method of accomplishing the cooling process after a flash dryer is shown in FIG. 3. After utilizing screen 32, for example 2"xO wet coal is screened and ¼"xO wet coal is passed via line 33 to a flash dryer 34 utilizing a hot drying gas 35. Dryer exhaust gas is passed via line 36 to a dust collector 37 and hot, dry coal is passed via lines 38 to be blended with wet coal via line 39 and the blend of wet and dry coal 40 is passed through a rotary cooler 41. Ambient air 42 is passed through the rotary cooler and cooler exhaust gas 43 is admitted to a second dust collector 44. The dust from this collector is then blended via line 45 with stream 46 to produce a final stream 47 of cool, dry 2"xO coal. Of particular merit is that cooling is accomplishing in the rotary cooling vessel 41 where the blend of wet and dry coal is tumbled in the rotary vessel through which ambient air is passed.

Other combinations of the above are feasible. The principle process is blending wet coal and hot dry coal before passing the blend into a vessel where ambient air is drawn through the bed of blended coal. The bed may be entrained (pneumatically conveyed or flash cooled) or can be fixed (fixed bed cooling) or a combination such as a vibrated fluid bed where bed material and entrained material are produced. The only constraint is that the cooling vessel must have adequate residence time (e.g. 1 to 10 minutes) and adequate ambient airflow rates (e.g. 10,000 to 100,000 standard cubic feet per ton of coal) to cool the coal to the desired temperature. Residence times and flow rates selected will be dependent on initial and final coal temperature, blend ratios, and ambient conditions. The ambient air can be conditioned (e.g., dried).

Where available, a dry inert gas at or below the ambient temperature could be used to cool the coal. In general, the cooling process will work best in environments where the ambient air humidity is low. This permits the air to absorb more water which allows more evaporative cooling. A humid cooling gas will absorb little water, thus allowing considerably less evaporative cooling. A very humid gas, such as the exhaust gas from the dryer, permits cooling only to its dew point. In the present case this dew point would normally be in excess of 100° F. and therefore would not produce a desirable coal product.

The foregoing description of the invention is merely intended to be explanatory thereof, various changes in the details of the described method and apparatus may be made within the scope of the appended claims without departing from the spirit of the invention.

What is claimed is:

1. A process for noncombustibly drying particulate coal comprising:
   separating the coal into a stream of coarse particles and a stream of small particles;
   noncombustibly heating and drying the stream of small particles;
   blending the heated stream of small particles with the stream of coarse particles; and
   cooling the combined stream of particles by passing ambient air through the combined stream.

2. The process of claim 1 including drying the small particles with a stream of hot air and recycling at least part of the stream of hot air.

3. The process of claim 1 including separating fine particles from the combined stream of particles and utilizing the fine particles as fuel to provide heat for heating and drying the stream of small particles.

4. The process of claim 1 in which an ambient temperature, dry inert gas is passed through the combined stream of particles.

5. The process of claim 1 wherein cooling is accomplished by tumbling the combined stream of particles in a rotary vessel and passing ambient air through the vessel.

6. The process of claim 1 wherein cooling is accomplished by passing ambient air up through the combined stream of particles in a fluid bed.

7. A process for noncombustibly drying particulate coal comprising:
   separating the coal into two streams;
   noncombustibly heating and drying one of the streams;
   blending the heated stream with the other stream; and
   cooling the combined streams by passing ambient air through the combined streams.

8. The process of claim 7 including drying the one stream with a stream of hot air and recycling at least part of the stream of hot air.

9. The process of claim 7 including separating fine particles from the combined stream of particles and utilizing the fine particles as fuel to provide heat for heating and drying said one of the streams.

10. A process for noncombustibly drying particulate coal comprising:
   separating the coal into two wet coal streams;
   passing one wet coal system into a dryer to form a bed;
   heating air in a furnace;
   admitting the heated air to the dryer to fluidize the bed;
   withdrawing dryer exhaust gas;
   passing the exhaust gas through a cyclone and withdrawing coal fines from the cyclone;
   withdrawing a hot, dry coal stream from the dryer;
   blending the drier hot dry coal stream with the cyclone coal fines;
   withdrawing cyclone exhaust gas;
   wet scrubbing the cyclone exhaust gas to form a coal fines slurry and scrubber exhaust gas;
   passing the coal fines slurry to a sedimentation pool;
   blending the second wet coal stream with the drier hot dry coal stream and the cyclone coal fines;
   passing the latter blended stream to a cooler to form a bed;
   fluidizing the latter bed with ambient air;
   withdrawing cooler exhaust gas and passing the gas to a cyclone;
   passing exhaust gas from the latter cyclone to a baghouse and collecting coal fines therein;
   passing the latter coal fines to the furnace as fuel for heating the air; and
   withdrawing cooled coal from the cooler and blending the cooled coal with coal fines from the latter cyclone.

11. The process of claim 10 wherein the two wet coal streams are formed by screen separating the coal into a coarse particle wet coal stream and small particle wet coal stream, and the small particle wet coal stream is passed to the dryer.

12. The process of claim 10 wherein part of the cyclone exhaust gas is recycled to blend with heated air from the furnace.

* * * * *